US005664785A

United States Patent [19]

Nguyen

[11] Patent Number: 5,664,785

[45] Date of Patent: Sep. 9, 1997

[54] AIRPLANE GAME

[76] Inventor: Hoang Van Nguyen, 89-25 Elmhurst Ave. - Apt. 203, Elmhurst, N.Y. 11373

[21] Appl. No.: 371,230

[22] Filed: Jan. 11, 1995

[51] Int. Cl.[6] ..... A63H 13/20

[52] U.S. Cl. ..... 273/442; 472/9

[58] Field of Search ..... 273/248, 249, 273/281, 440, 441, 447, 448, 442; 472/9, 10

[56] References Cited

U.S. PATENT DOCUMENTS

| | | | |
|---|---|---|---|
| 1,561,402 | 11/1925 | Bernwall | 273/241 |
| 1,719,252 | 7/1929 | West et al. | 472/10 |
| 2,185,556 | 1/1940 | Johnson | 273/241 X |
| 2,521,620 | 9/1950 | West et al. | 472/10 |
| 2,634,165 | 4/1953 | Murphy | 472/9 X |
| 2,680,619 | 6/1954 | Reiter | 472/10 X |
| 3,014,718 | 12/1961 | Telzrow | 472/9 |
| 3,512,773 | 5/1970 | Jacobs | 472/9 |
| 3,556,520 | 1/1971 | Hunt | 472/9 |
| 3,731,424 | 5/1973 | Meyer | 472/10 |
| 4,688,787 | 8/1987 | Vidal | 472/9 |
| 4,761,006 | 8/1988 | Ledbetter | 273/442 |
| 5,102,126 | 4/1992 | Nguyen | 472/9 X |
| 5,351,955 | 10/1994 | Danby | 273/141 R |

FOREIGN PATENT DOCUMENTS

| | | | |
|---|---|---|---|
| 2550673 | 5/1976 | Germany | 472/10 |

*Primary Examiner*—William E. Stoll

*Attorney, Agent, or Firm*—Kane, Dalsimer, Sullivan, Kurucz, Levy, Eisele and Richard, LLP

[57] ABSTRACT

A toy airplane game involving a central upright member, flying device, airplane tether mechanism attached to the flying device, and landing area, wherein the operator controls the operation of the flying device in takeoff, flying and landing to different predetermined location on a map or the like.

6 Claims, 8 Drawing Sheets

AIRPLANE GAME

The airplane game is an educational game. It is not only designed to teach the user how to maneuver a flying plane, but also to learn the location of countries on continent maps by flying an airplane on its roulette. It is utilized by two operators who fly their airplanes and locate a certain country on a continental map. The present game is new and unique, simulating features of real airplane maneuvers such as take-off, ascent, descent, and touchdown.

SUMMARY OF THE INVENTION

Operators play the game which generally relates to a model aircraft drive. The system includes countries with their borders on continent maps. The name of the country, or its capital city or a landmark in that country continuously flash one at a time. Also included are two roulette disks, two airplanes, two remote controls, two battery boxes, electrical wires and small light bulbs. An airplane connected to a roulette disk by a plastic stick and strings revolves and flies around by its propeller to simulate real airplane flight maneuvers.

When the operator begins pressing the speed control on the remote control, the airplane will move on the runway of its roulette causing the light of each country on that continent map to flash continuously and the names of the countries to be lit. If the operator wants the lights of the countries to continue flashing, after the airplane takes off, he/she has to turn the light switch on the remote control but the operator must turn it back when a landing occurs. The remote control has a speed control, an altitude control, a button and switch for the range of an airplane, and a light switch. While flying, the airplane can be raised or lowered by the speed of its propeller to simulate ascent or descent. The speed control is pressed to move the airplane on its roulette runway and fly it around the roulette disk. When the operator presses hard, the airplane flies very fast at an higher altitude, but if he/she presses the altitude control, the airplane could reach its highest altitude which would illuminate the light on the top. At this point, the airplane should be released by pressing the altitude control which causes the motor at the other end of the plastic stick to let the strings extend out of the roulette range as far as they can go. At that time, the airplane will fly at its utmost range and the lights at the wing ends will be lit. When this happens, the operator has to prepare for a landing. He/she has to turn a switch at the range switch button and then press the range button to bring the airplane back into the roulette range. He/she also has to turn a light switch which would flash the light of each country on a continent map where the airplane intends to touchdown. The Operator has to release, little by little, a speed control, while maintaining altitude control so as to lower the plane as much as possible in order to have a touchdown when the situation is appropriate. When the airplane has successful touchdown the light of the indicated country flashes, meaning he/she has landed the airplane on the right spot earlier than any other airplane, and he/she is the winner.

The propeller of the airplane is operated by the speed control which provides simulation of the actual altitude of the airplane during operations such as banking, ascending, descending, landing, and take off. The airplane game is played indoors but can be played outdoors as well and truly provides the three-dimensional control and drive of a model airplane to more realistically simulate the actual flight conditions of an aircraft such as take-off, changing altitudes, and landing, and is more entertaining because of the lights on the top, the bottom, and at the ends of the aircraft wings which flash on and off.

The invention comprises an inclusive system which provides forward motion for a model aircraft on a flight around a roulette disk with pitch and roll maneuvers. The model aircraft is attached to a plastic stick with strings which allow it to be raised up or lowered by its propeller and provide changes in rolling and pitching during aircraft maneuvers. The strings attached to the aircraft thereby hold the aircraft to the plastic stick and allow the aircraft to fly almost freely while maneuvering its real flight. Thus utilizing the instant model aircraft control system, an operator may simulate all aircraft maneuvers including take off and landing plus a variety of standard acrobatic flight maneuvers to provide more realism to the same. The system may also be utilized for teaching aircraft flight maneuvers and learning to locate different countries, their capitals, and their landmark names on continent maps.

The object of the game is to achieve a successful flight by moving on the runway of the roulette disk, causing the light of each country name, the light of its capital name, or the light of its landmark name to flash one at a time and continuously. The system is built to simulate the flying of an aircraft during take-off, ascent, descent, and landing. When a landing occurs, the airplane will touchdown on a certain spot of the roulette disk which will be evident at once by the flashing light of the indicated country, or the light of the named capital, or the light of the referenced landmark on the continent maps standing behind the roulette disks.

The game is also educational and includes continent map(s) with their bordered countries, capitals, and landmarks represented by small colored light bulbs. Two roulette disks, revolved shaped in their center, two airplanes, two battery boxes, two remote controls, electrical wires, and light bulbs are included. The game is designed to be played both indoors and outdoors.

A toy aircraft flight drive and control system for propelling and simulating aircraft maneuvers includes a model aircraft which contains a motor inside its nose with a propeller in front to enable the aircraft to take off, and simulate the actual flight of a real aircraft. The model aircraft structure itself includes a motor in its nose which can be manipulated by a remote control to change its altitude. A flight panel includes a remote control for providing the model aircraft with variable speed altitude changes and flight altitude changes while revolving around a roulette disk attempting locate a specified country, or a named capital, or a particular landmark.

The model or toy aircraft is connected to the revolved shaped center of the roulette disk by a plastic stick which can be raised up or lowered to make altitude changes and by strings which can release the aircraft out of the roulette range. This is a very important feature in that real aircraft perform in the same manner. Flying an aircraft by strings and by remote control is a fantastic experience which gives the same feeling as controlling an aircraft by a remote control on a field. Therefore, the model or toy aircraft is capable of taxiing, taking off, landing, climbing, diving, level flight and various three-dimensional flight paths describing sine waves, parabolic and hyperbolic patterns and most standard acrobatic maneuvers. The light on top of the aircraft lights when it reaches the highest altitude, lights at the wing ends of the aircraft light when it flies at its utmost range, and a light at the bottom of the aircraft lights when it makes a landing. In addition, while moving on its runway or flying, the lights of countries and then capitals are flashing continuously.

The smoothness of the flight attitude, profile, and an accurate landing on a specified country, on a named capital, or on a particular landmark will be dependent upon the skill, dexterity, and coordination of the operator. It requires an operator to know where an exact location is on the roulette disk, this is transmitted to the continent map(s) making the light of the location flash, and the light at bottom of the aircraft to go on. This indicates that he/she has landed on the right spot.

One objective of this invention is to provide a model aircraft flight control system for simulating all conventional flight attitudes including take-off, landing, various positions, and basic standard purposes. It also requires all components of the system to work accurately and to perform as designed.

A second objective of this invention is to provide the two-way motion of a motor attached to a plastic stick releasing the aircraft out of roulette range and winding it back into roulette range, and the two-way motion of another motor inside the revolved shaped center of the roulette disk bringing the aircraft up to its highest altitude and bringing it down for a touchdown thus making a complete landing. Of course, it requires the skill of an operator for the system to function properly.

A third objective of this invention is to provide a model aircraft propulsion system in which the model aircraft is connected to a plastic stick and strings and controlled vertically and horizontally for upward and downward movement to perform actual aircraft maneuvers. While performing a flight, lights will go on or flash.

A fourth objective of this invention is to provide a model aircraft flight control system for indoor or outdoor use which allows operators to simultaneously provide forward motion, altitude control, and aircraft flight attitude control such that the aircraft simulates flying by its propeller, imitating a real aircraft flight.

In accordance with these and other objects which will be apparent hereinafter, the instant invention will now be described with particular reference to the accompanying drawings.

DETAILED DESCRIPTION OF THE PREFERRED EMBODIMENT

The airplane game is introduced as a game for educational and entertainment purposes an operator maneuvers an aircraft that flies and circles a roulette disk, while locating countries, capitals, and landmarks on continent map(s). The function of the game's system will be explained in detail herein.

Figure 1:
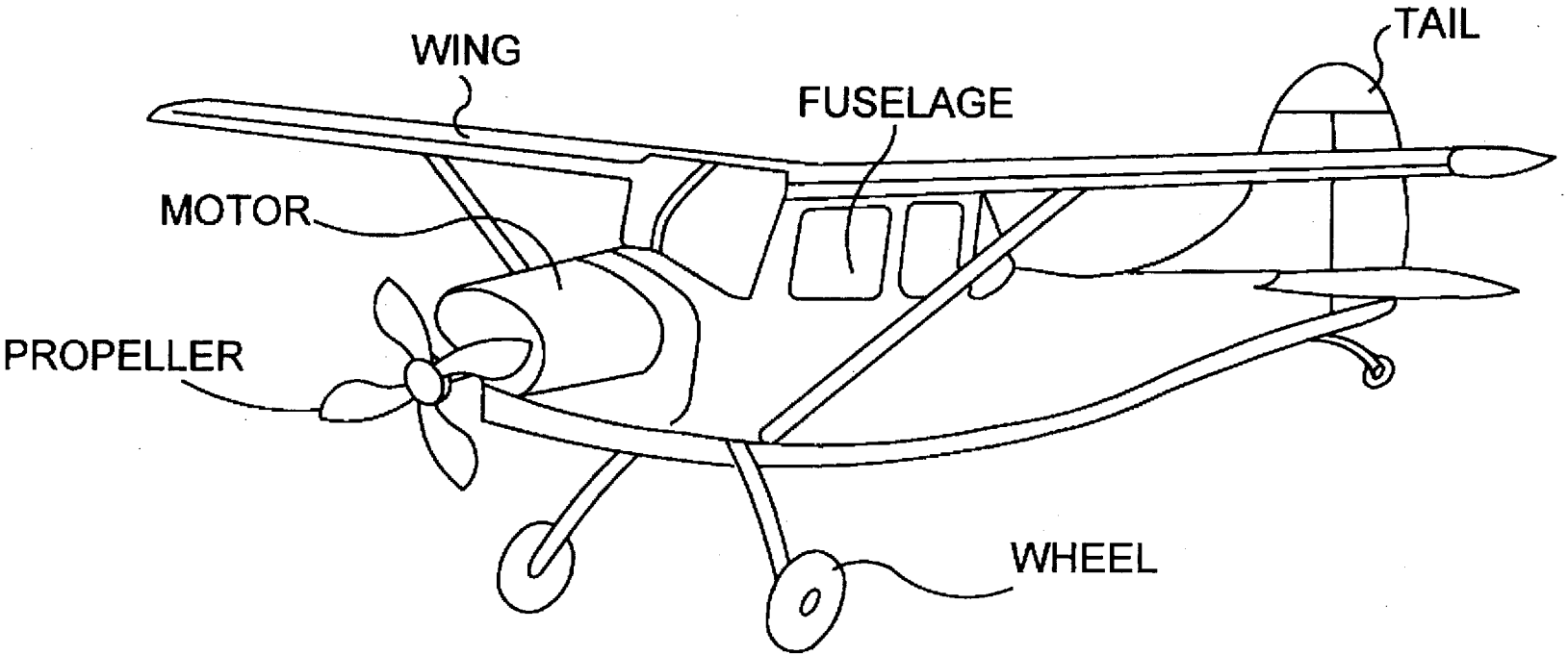
FIG. 1 shows an aircraft with its motor at the nose and its propeller in front.
Figures 2, 3:
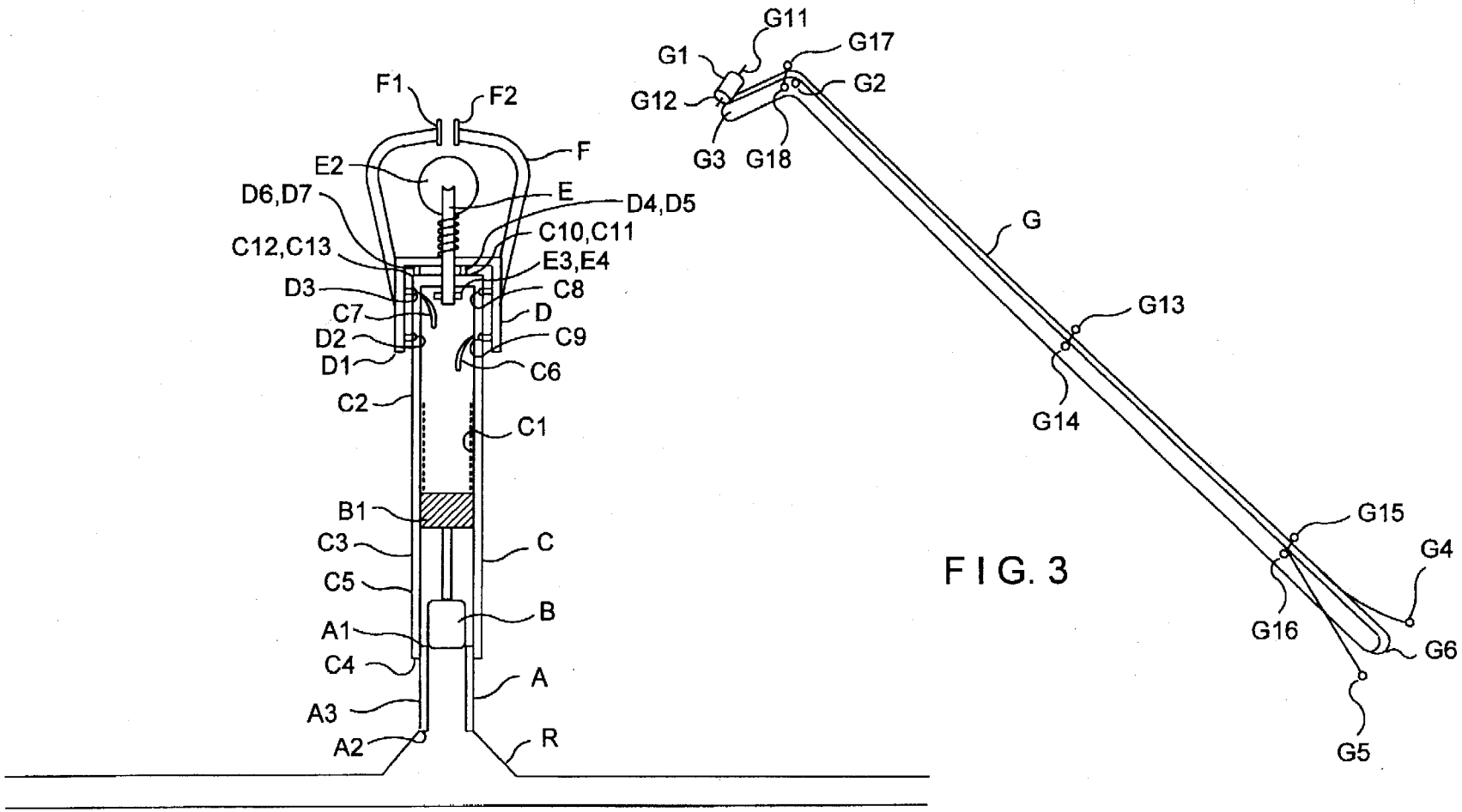
FIG. 2 shows a centered shape system of the roulette desk.
FIG. 3 shows a plastic stick with the motor releasing and winding up the strings attached to it.
Figure 8:
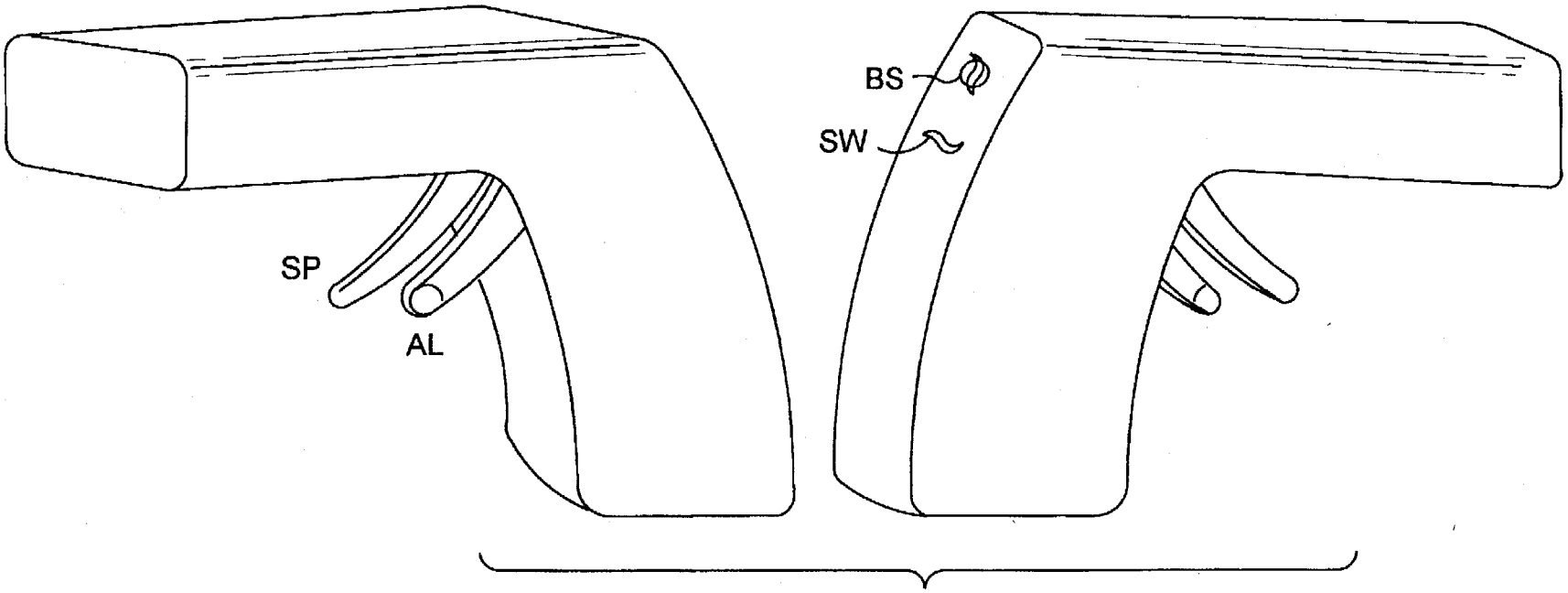
FIG. 8 shows a remote control in two positions with its speed control, altitude control, range switch button, and light switch.
Figure 9:
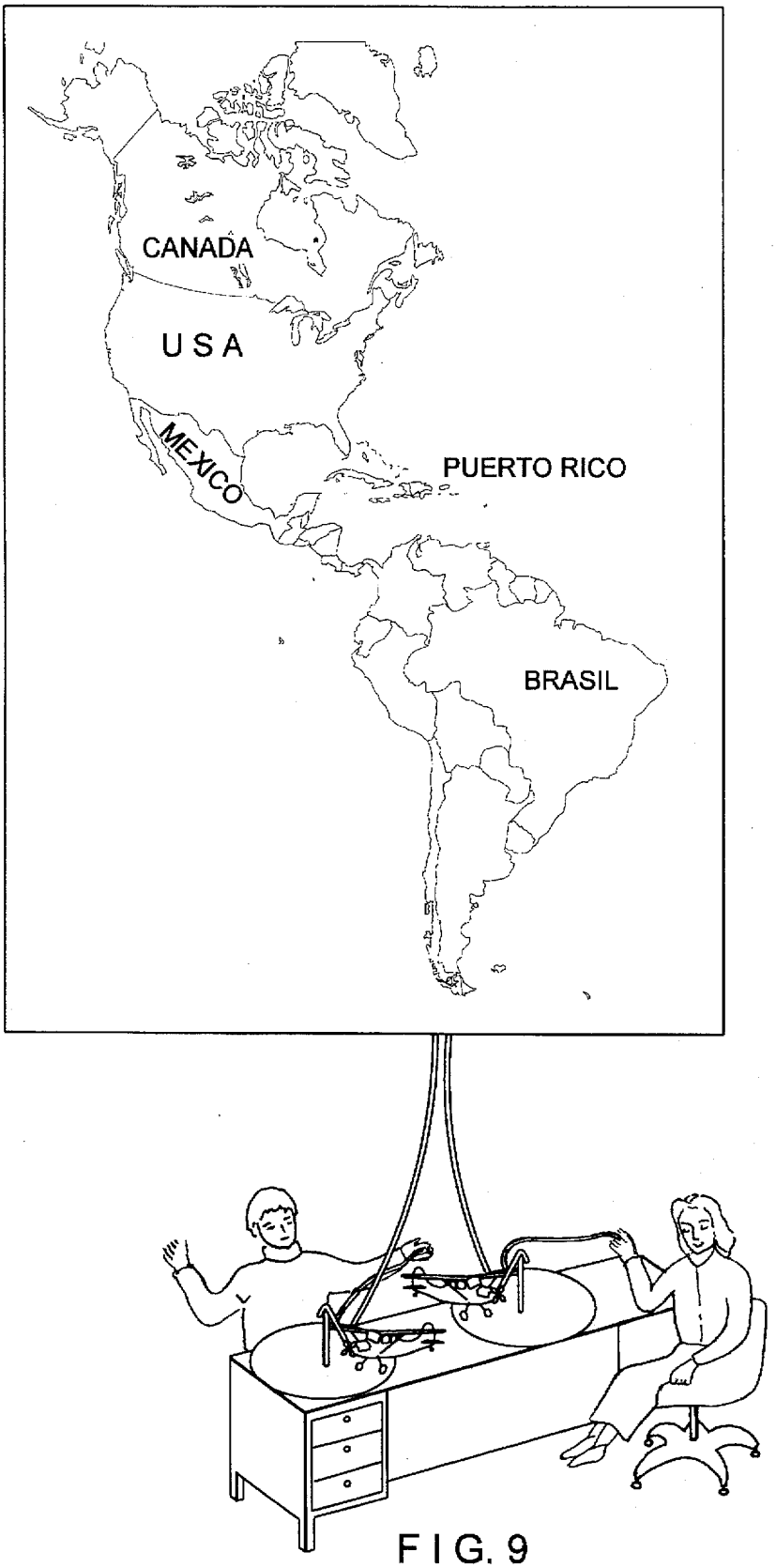
FIG. 9 shows an overall picture of the toy game to be played.

FIG. 1 shows an aircraft with its motor at its nose and a propeller in front. FIG. 2 has a centered shape system that would be used to control the toy game. When a speed control SP (FIG. 8) is pressed, it causes a close circuit through C12, D6 and C13, D7 to make a motor in the aircraft nose run and the propeller in front revolve (FIG. 1). The propeller makes the aircraft, including shape D, shape F, shape G, and D4, D5, D6, D7 revolve around shape C. Shape D has eight little wheels D2, D3 and its adjacent site D21, D31 (not shown); C8, C9 and its adjacent site C81, C91 (not shown); and all upper little wheels C8, D3, C81, D31 and lower little wheels D2, C9, D21, C91 are in a square position which run along the route deep down on shape C. While the aircraft is moving on its runway on the roulette desk (FIG. 4), its wheel will make a close circuit at CI1, CI2, CI3, CI4, and so on (FIG. 4), depending on how many countries there are on the continent map, which will be evident at once by the flashing light of each country, the capital or its landmark on that map standing up behind the two roulette desks (FIG. 9).

Figure 4:
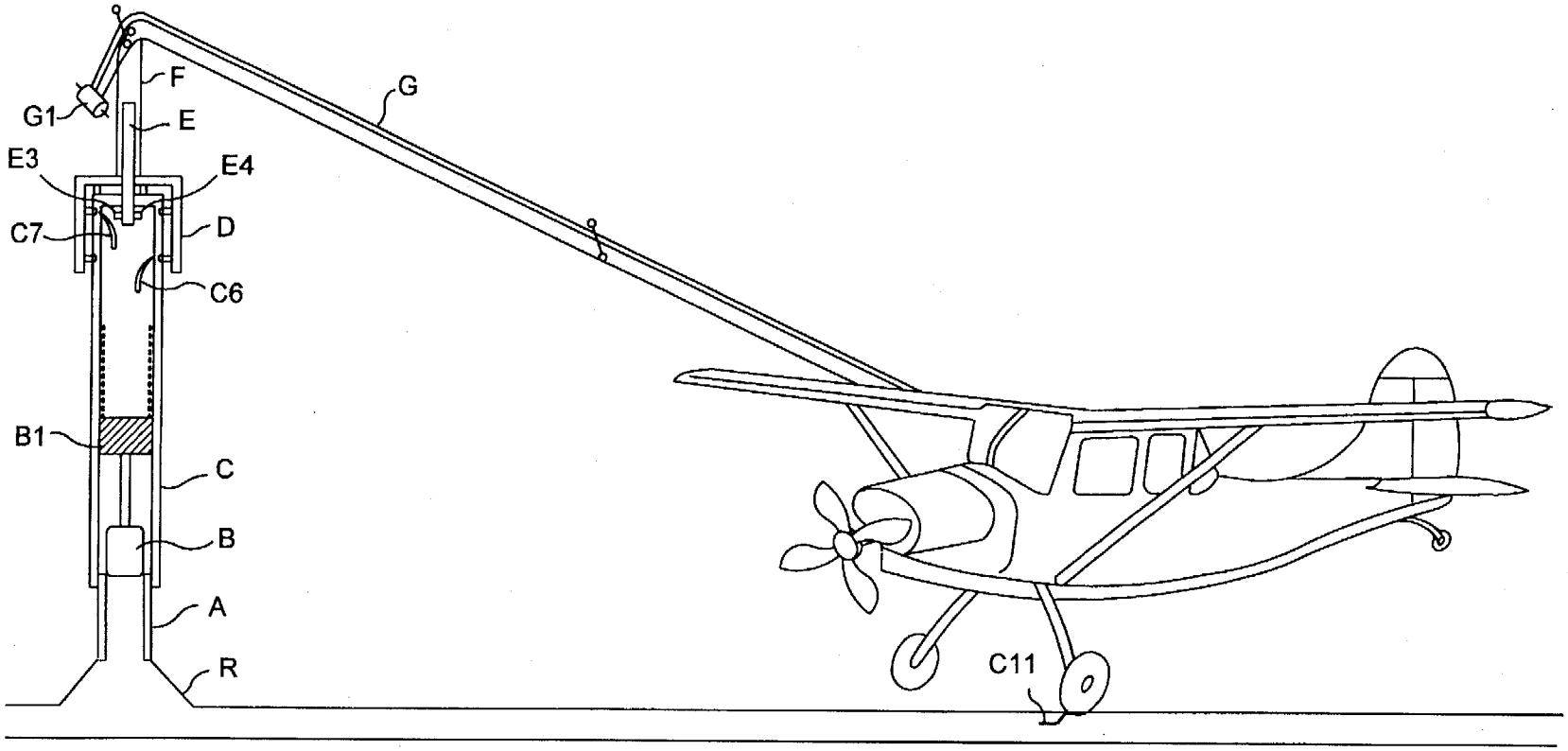
FIG. 4 shows a centered shape system with the aircraft performing on its runway.
Figure 5:
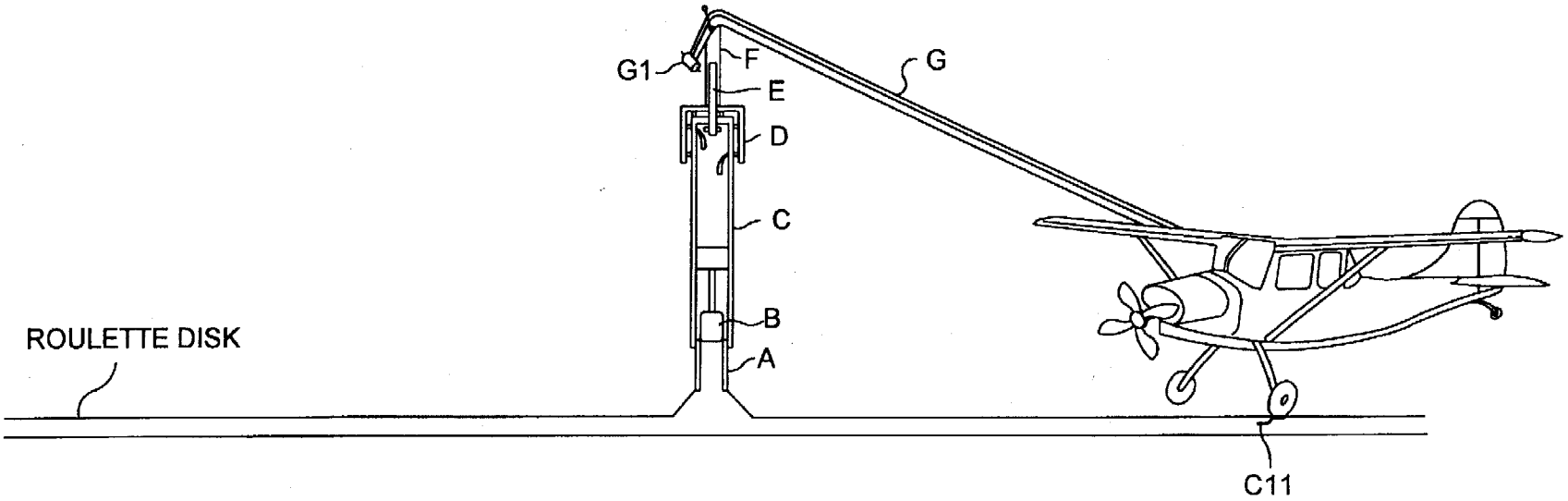
FIG. 5 shows a roulette disk with its centered shape system and aircraft.
Figure 6:
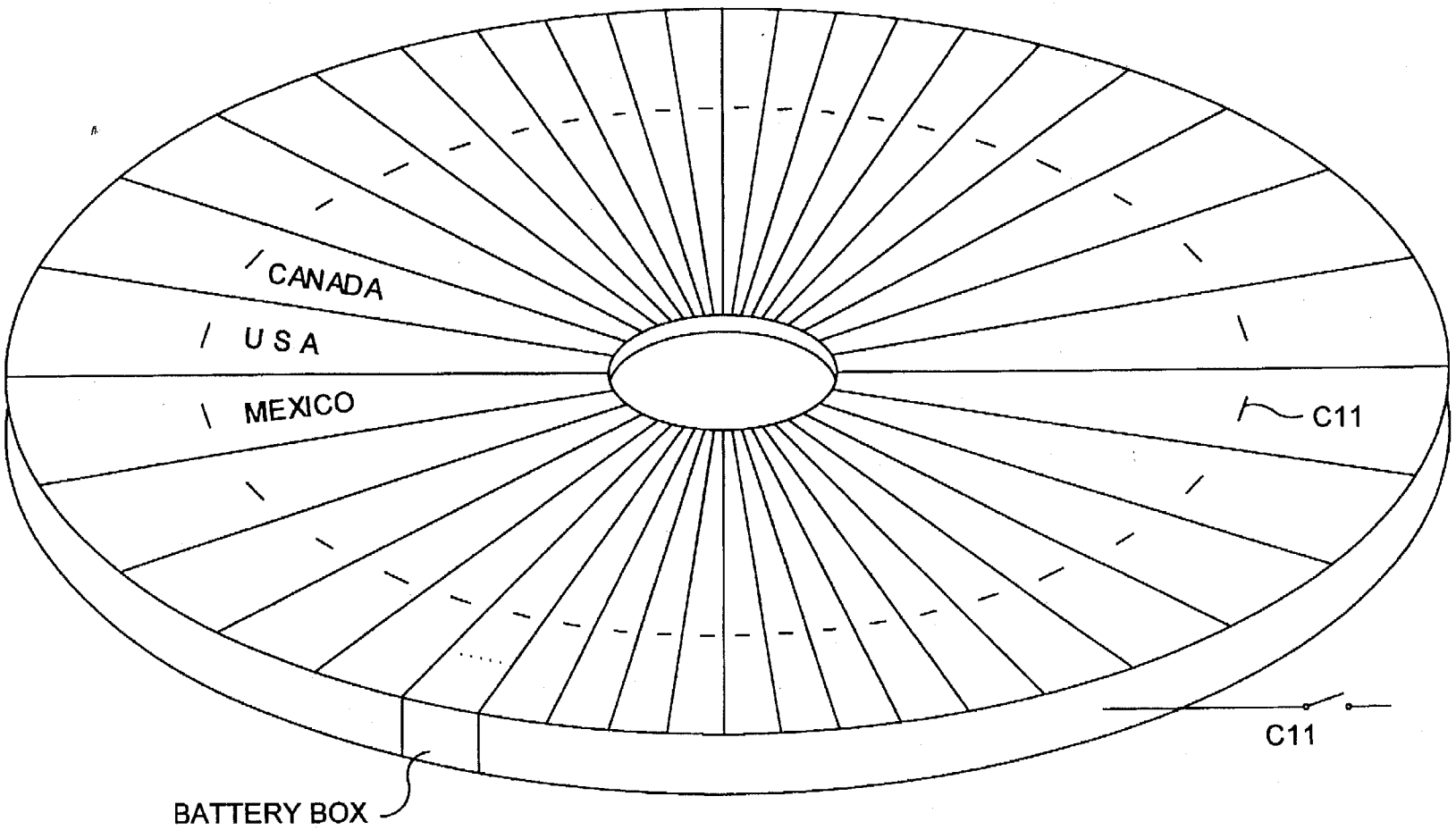
FIG. 6 shows a roulette disk with its pie spot representing a certain country on the map.

FIG. 3 indicates a plastic stick and strings are used to raise up at G4, G5, G6 and lower at G3 (FIG. 7) or vice versa. FIG. 4 shows an aircraft with its plastic stick lowered and strings at G4, G5, G6 and raised up at G3 while it is moving on its runway of the roulette disk. FIG. 5 shows the roulette disk with its centered shape system. FIG. 6 shows a roulette with its pie spots representing certain countries on the continent map(s). The aircraft moves on its runway and the propeller makes the aircraft take off which raises G4, G5, G6 up and lowers G3 down (FIG. 3). When G3 is going down, it pushes dish E2 down and presses shape E down causing E3 to touch C7, a down piece (FIG. 2). Contact will make the motor B operate if operator presses an altitude control AL that would lower shape C going down. Segments C5 and A3 must be equal and segments C2 and C3 (FIG. 2) are the safe areas where electrical wires connect all parts of the system.

Figure 7:
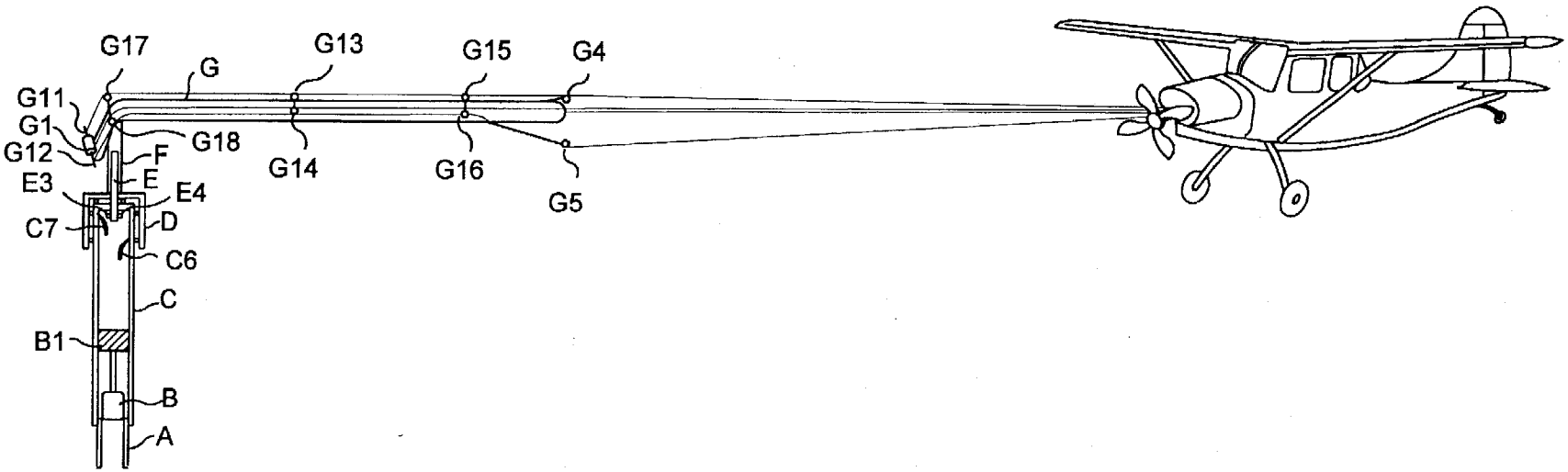
FIG. 7 shows an aircraft flying out of roulette range by its strings.

If operator presses his/her speed control SP harder, that will make the aircraft fly faster, raising its altitude and that also makes E4 touch C6, an up piece (FIG. 2), at that time E3 would disengage C7, and if he/she presses an altitude control AL he/she is running motor B in reverse and bringing shape C up (FIG. 2). This will make the aircraft fly at its highest altitude. When this happens, C4 touches A2 causing the light on the top of the aircraft to turn on. At this moment, FIG. 7 shows the aircraft flying at its utmost range because the operator presses a switch button BS to run motor GI releasing the aircraft out of the roulette range by a string at G11 through G17, G13, GI5, G4 and by a string at G12 through GI8, G14, G16, G5. All electrical wires through G6 which are connected to the aircraft would be released automatically. When the aircraft reaches its utmost range, two lights at the wing ends will be turned on.

At this point, while the aircraft flies at its highest altitude with the top light on and at its utmost range with the lights at the ends of its wings on, it is time to prepare for a landing. The operator has to reverse the switch of the switch button BS and when he/she presses the button BS this causes the motor GI to wind up the strings and bring the aircraft back into the roulette range. It is also time to reverse the light switch SW as shown in FIG. 8 in preparation for the aircraft's landing. When the aircraft is within the roulette range, the operator releases the speed control SP slowing the aircraft's speed causing G4, G5, G6 to go down and G3 to go up which means shape E goes up. When shape E goes up, E3 touches C7, a down piece, again and if the Operator presses the altitude control AL this causes the lowering of shape C until C4 touches AI making the light at the bottom of the aircraft go on (FIG. 5). Now is the time for a touchdown when an appropriate situation occurs that lets the operator A see a chance for his/her aircraft to touchdown right on a named spot. If he/she lands on the right spot on the roulette disk that will be evident at once by the flashing light of the country name or capital or landmark on the continent maps. If the operator's aircraft has a touchdown earlier than the other aircraft touchdown, he/she is the winner. FIG. 9 shows an overall picture of how the game is played by two operators.

This product is not only entertaining but also educational, in that it shows the locations of countries, capitals, and landmarks on continent maps, and teaches how to land an aircraft on any named country, capital, or landmark chosen by one self or by another operator. Operators who play

What is claimed is:

1. A flying game comprising:

a central upright member;

a flying device;

a tether means tethering the flying device to the upright member; said tether means comprising flexible strings coupling the flying device to the central upright member; said strings having a portion thereof passing through a rigid straight member coupled to the central upright member, said rigid member being of sufficient length to extend from the central member to the flying device when said device is taking off or landing, winding means to allow said strings to pay out beyond the rigid member and to be rolled in;

a game board on which the flying device lands and takes off from designated locations; and control means for controlling the flying devices movement including speed, altitude, landing, and take off.

2. The game in accordance with claim 1 wherein said game board is circular in shape, with the central upright member located in the center thereof.

3. The game in accordance with claim 2 wherein said designated locations are on the game board and comprise pie shaped segments which are designated geographic locations.

4. The game in accordance with claim 3 which includes a map with geographic locations corresponding to predetermined locations on the game board.

5. The game in accordance with claim 4 wherein contact between the flying device and respective predetermined locations is indicated at respective predetermined geographic locations on the map.

6. The game in accordance with claim 2 wherein said flying device is a motorized airplane.

* * * * *